US005233711A

United States Patent [19]

Urai et al.

[11] Patent Number: 5,233,711

[45] Date of Patent: Aug. 10, 1993

[54] CUSHION BODY AND METHOD OF FORMING SAME

[75] Inventors: Muneharu Urai; Masagoro Toyoshima, both of Akishima, Japan

[73] Assignee: Tachi-S Co., Ltd., Akishima, Japan

[21] Appl. No.: 698,170

[22] Filed: May 10, 1991

[30] Foreign Application Priority Data

May 31, 1990 [JP] Japan ..... 2-139818

[51] Int. Cl.[5] ..... A47C 27/20

[52] U.S. Cl. ..... 5/481; 5/475; 297/452.26

[58] Field of Search ..... 5/475, 478, 481, 268; 297/459, DIG. 1

[56] References Cited

U.S. PATENT DOCUMENTS 2,994,890 8/1961 Wagner ..... 5/481 X
3,069,701 12/1962 McInerney ..... 5/481 X
3,099,844 8/1963 Bolesky ..... 5/481 X
3,454,054 7/1969 Docker ..... 5/47.5
3,480,703 11/1969 Morita et al. ..... 297/DIG. 1
3,681,798 8/1972 Docker ..... 5/425
4,958,394 9/1990 Urai et al. ..... 5/481 X

FOREIGN PATENT DOCUMENTS 55-20912 9/1980 Japan .

*Primary Examiner*—Michael F. Trettel
*Attorney, Agent, or Firm*—Oldham, Oldham & Wilson Co.

[57] ABSTRACT

A cushion body including a continuous coil-spring assembly which comprises coil portions and linear connection portions, and a method for forming such cushion body. The continuous coil-spring assembly is pressingly inserted into a jig, and both jig and coil-spring assembly are subject to a low-temperature annealing treatment. Thus-treated coil-spring is then foamed with a urethane base material in a mold, so as to produce such sort of cushion body.

7 Claims, 5 Drawing Sheets

CUSHION BODY AND METHOD OF FORMING SAME

BACKGROUND OF THE INVENTION 1. Field of the Invention

The present invention relates to a cushion body having a steel spring assembly embedded therein, and a method of forming the same. More particularly, the invention is directed to such cushion body for use in an automotive seat, which employs a continuous coil-spring assembly comprising coil spring portions and linear connection parts connecting them integrally together.

2. Description of Prior Art

Coil-spring assembly of a unitary or continuous type, typically, includes an entangled spring assembly as shown in FIG. 1*a*, and a non-entangled, sequential coil-spring assembly as shown in FIG. 1*b*.

This sort of spring assembly is usually employed in forming a cushion body for automotive seat. Namely, the spring assembly is integrally embedded in a polyurethane cushion member (which will be referred to as a "urethane member"). FIGS. 2 to 4 illustrates examples of how the spring assembly is embedded in that member.

Those spring assemblies are formed by subjecting a straight spring material (a steel wire material), of approx. 2.0 $\phi$ in wire diameter, into a machining work process. Their given outer configurations are set due to their respective self-recovery properties, depending upon such conditions as their wire diameters, high-tensile strengths, and upon whether they are easy or hard to be worked by the machining process. This is found to be an obstacle limiting free design applicability in the case where the spring assemblies are used in the automotive seat, because of their non-flexibility for various formations in various dimensions.

Such continuous series of coil springs, which form a row of springs in a line, are normally subject to a settling or setting process, by repeating several strokes of applying a given load to the springs, so as to eliminate an initial changeable setting thereof. By such method, an initial height of springs (e.g. 150 mm) is settled down to a low, unchangeable height (e.g. 120 mm). However, a resulting spring produced by this setting process is unchageable in formation and thus can not be reduced in height. For this reason, the above-noted problem, namely, the dimensional limitations and limited desingn applicability, has remained yet to be solved.

This problem in particularly notable when such spring assembly is applied in an automotive bucket seat whose both sides are formed curved upward to project higher, each having stepped part. In this case, the urthane member has been formed thick at the corresponding area. Further, in the case of such rear-seat seat cushion having a tunnel area formed in its bottom, there has been no other way but to embed in the cushion member thereof a specially formed coil-spring assembly having a lower spring area.

Additionally, when the continuous coil-spring assembly is set in the molding for foaming together with the urethane member, it is difficult to dispose the assembly in a uniform way, although not requiring a frame wire member, particularly, it is difficult to set a proper height of the spring in order to leave an even thickness of urethane member above the spring.

SUMMARY OF THE INVENTION

It is a first purpose of the present invention to provide cushion body and method of forming the same, which permits direct integral foaming of an urethane base member together with a singular row of or plural rows of continuous coil-spring assemblies, without requiring repeated settling steps and other special support members therefor.

To achieve such purpose, according to the present invention, there is employed a jig for temporarily accommodating therein the continuous coil-spring assembly, and there are basically provided the steps of inserting pressingly the coil-spring assembly into such jig then subjecting both jig and coil-spring assembly to a low-temperatrue annealing treatment, thereafer, temporarily securing thus-treated coil-spring assembly onto securing members in a mold, and effecting a foaming in the mold to produce an integral foam urethane body having the coil-spring assembly integrally embedded therein.

Accordingly, the low-temperature annealing treatment effectively burns up a thing attached to the surface of coil-spring assembly, such as an oil, thereby offering an easy and far-improved bonding between the coil-spring assembly and foam cushion body. Further, the provision of the securing members in the mold for temporarily securing the coil-spring assembly, during the urethane foaming steps, serves to firmly locate and support the coil-spring assembly without roquring other support means, and also be allow the coil-spring assembly to exert its spring characteristics directly without influence from the surrounding foam urethane member.

It is a second purpose of the present invention to enable forming the continuous coil-spring assembly into a desired shape in conformity with an uneven portion of seat.

To this end, according to the invention, there is provided a jig of ⊐ shaped configuration having a vertically bent part formed therein, thereby defining an adequate opening height to receive the coil-spring assembly therein according to a required coil height of the assembly, so that the coil-spring assembly is pressingly inserted into such jig, thereby being setted in a given shape, and subjected to the low-temperature annealing treatment.

Accordingly, a resultant coil-spring assembly is formed in a required shape conforming to an uneven portion of seat.

DETAILED DESCRIPTION OF PREFERRED EMBODIMENTS OF THE INVENTION

Figure 1:
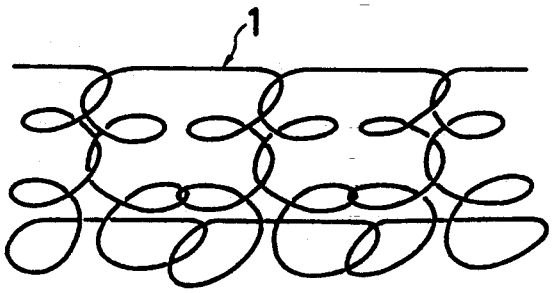
FIG. 1*a* is a partial, schematic perspective view of an entangled coil-spring assembly.
FIG. 1*b* is a partial, schematic perspective view of a non-entangled, sequential coil-spring assembly.
Figure 1:
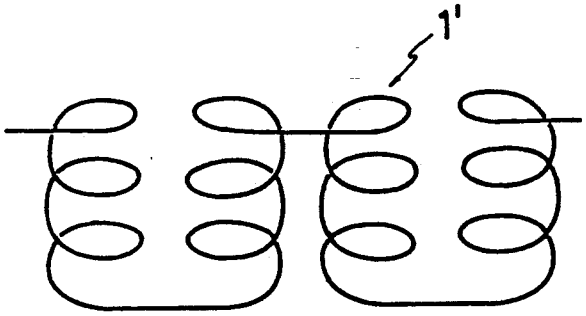
Figure 2:
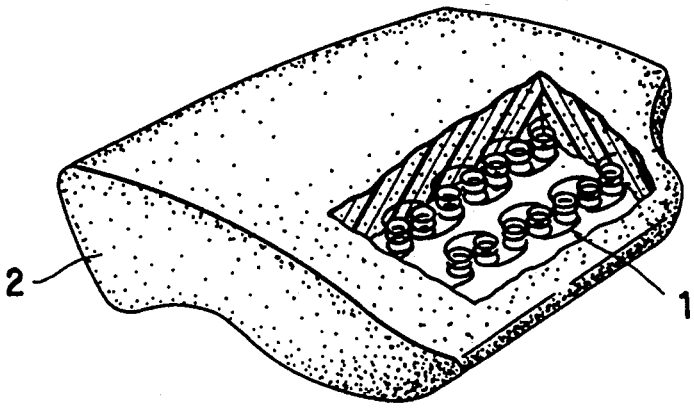
FIGS. 2 through 4 show several embodiments showing examples of installing the entangle coil-spring assembly in a cushion body.
Figure 3:
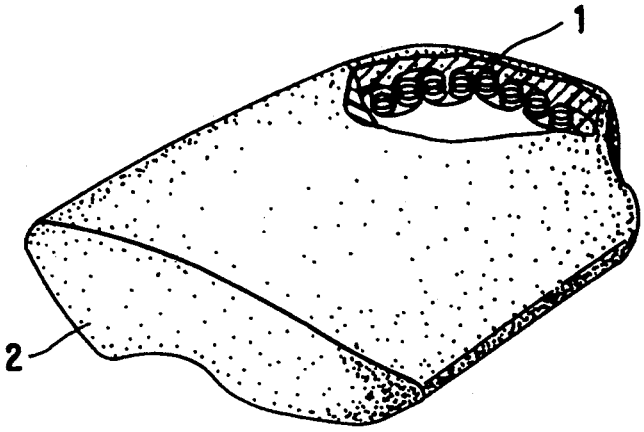
Figure 4:
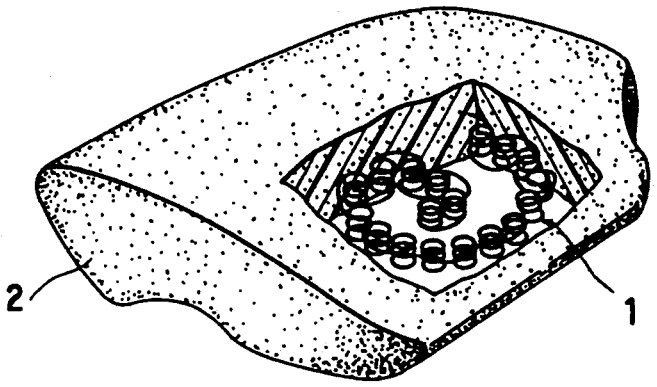

As stated in the previous description, the present invention is applicable to both of the entangled coil-spring assembly (1) shown in FIG. 1*a* and sequential one (1') shown in FIG. 1*b*. But a hereinafter description will be made of the latter in the several embodiments shown in FIGS. 5 thorough 13.

Figure 5:
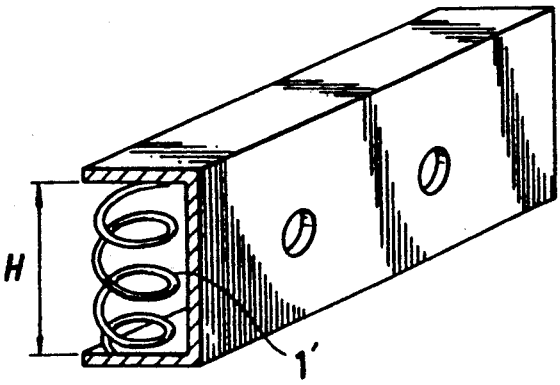
FIG. 5 is a perspective view of a first embodiment of the present invention, showing the state where the sequential coil-spring assembly is inserted in a jig.

FIG. 5 illustrates schematically the state where the spring assembly (1'), which has been preformed, is placed in a jig (3) of ⊐-shaped configuration having a lower height (H) than the initially set height of the spring assembly. Spring assembly (1') thus compressed in the jig (3) is then subject to a low-temperature annealing treatment, together with the jig, by means of an electric furnace for example. Thus, the spring assembly is settled at such height (H) given by the jig (3) so as to be made stable in terms of shape and spring characteristics. Preferably, the low-temperature annealing treatment should be effected at approx. 300° C. for 3 to 10 min. or 270° C. for 5 min. or so, whereby the limit of elasticity of spring assembly is enhanced and a difference in strain between the initially formed state and subsequently formed state of the spring assembly (1').

Figure 6:
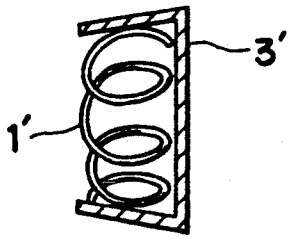
FIG. 6 is a sectional view of a second embodiment of the present invention.

FIG. 6 shows a second embodiment wherein another jig (3') is provided, which is slightly different in shape from the foregoing jig of first embodiment. Namely, the height between the opening side of the jig (3') is narrowed a little inwardly relative to a vertical line. This jig (3') is effective in preventing the spring assembly (2') against coming off from the jig during the annealing treatment. This embodiment produces the same effect as in the first embodiment above in terms of the annealing treatment.

Figure 7:
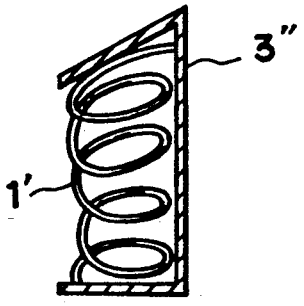
FIG. 7 is a sectional view of a third embodiment of the present invention.

FIG. 7 shows a third embodiment of jig which is suited for forming spring assembly (1') into a configuration fitting a slantly elevated portion (i.e. so-called flap portion) of a bucket-type seat. Such jig is designated by (3'') and shown as being formed such that its upper part is sloped in conformity with such flap portion of bucket-type seat, whereby the spring assembly (1') is processed through the foregoing low-temperature annealing treatment into the one having the slant upper end portion. It is noted that FIG. 9 shows an example of die in which such spring assembly whose upper part is formed slant is used at each of portion corresponding to respective both sides of die, as will be described later.

Figure 8:
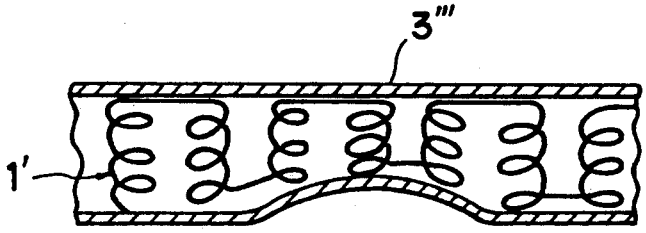
FIG. 8 is a sectional view of a fourth embodiment of the invention.

FIG. 8 shows a fourth embodiment of jig which is designated by (3'''), whose lower side is formed with a recessed area, according to which, the spring assemlby (1') intended for use in a rear-seat seat cushion is stored in the jig (3''') for the lower-temperature annealing treatment. Use of this jig (3''') permits formation of the spring assembly into the one having a uniform spring height, excepting its lower side which is raised centrally thereof: Namely, the lower side of spring assembly is reduced in height at its central point and can be set accordingly by the low-temperature annealing process.

Figure 9:
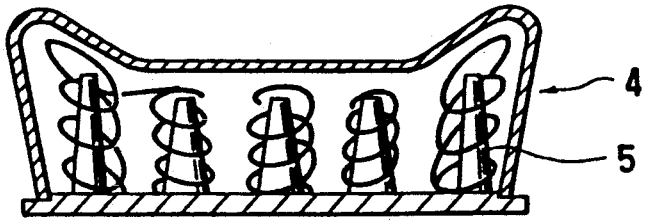
FIG. 9 is a sectional view of mold for foaming an urethane base material, which is adapted for forming an automotive bucket-type seat.

FIG. 9 illustrates an example of how the spring assemblies formed by the jigs (3), (3') and (3'') are disposed in an urethane foaming mold (4). Specifically, as shown, in the mold (4), three separate rows of spring assemblies, which have been formed by the jig (3) or (3'), are temporarily secured at their respective coil portions to each of truncated-conical securing members (5) or simply conical ones which are located at center of mold (4), while on the other hand, the spring assemblies formed by the jig shown in FIG. 7 are temporarily secured at their respective coil portions to each of two securing members (5) located at respective both lateral sides of mold (4). Thereafter, a urethane base material is foamed within thus-set mold (4) so as to produce a cushion member integral with the spring assemblies. It is noted here that each of the spring assemblies may be varied from one another in wire diameter, depending on which portions of seat are to be applied to respective those spring assemblies.

Figure 10:
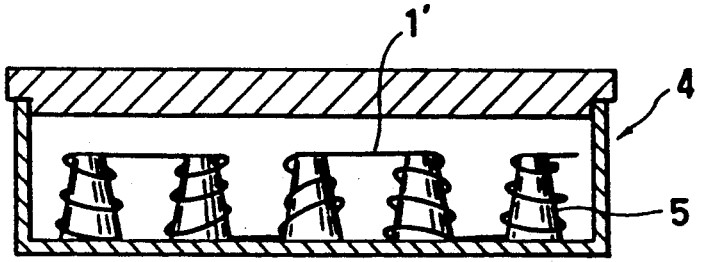
FIG. 10 is is sectional view of an ordinary mold for foaming an urethane base material.

FIG. 10 shows an ordinary embodiment of mold generalized from the foregoing mold (4), in which the truncated-conical securing members (5) are fixed on the lower mold of mold (4), and to the respective securing members (5), are fitted or temporarily secured the coil portions of the spring assembly (1').

Figure 11:
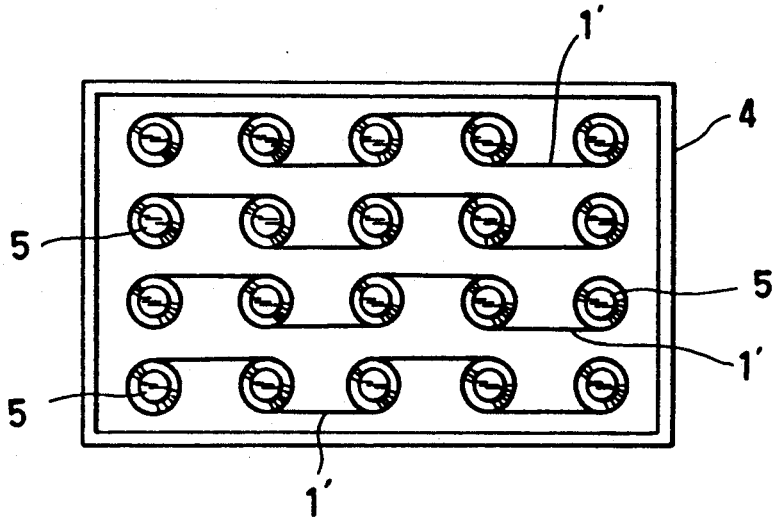
FIG. 11 is a plan view of such ordinary mold.

FIG. 11 shows, in plan, this structural state of mold (4). Under that condition, an upper mold is placed on the lower mold, and then a foaming is carried out within those two molds.

Figure 12:
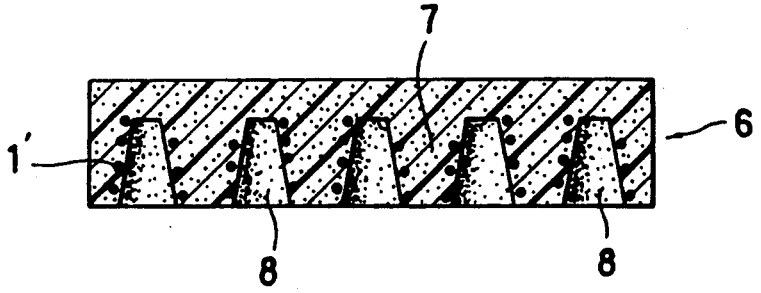
FIG. 12 is a sectional view of a resulting cushion body.

As shown in FIG. 12, a resultant cushion body (6) produced by the mold (4) is a foam urethane member (7) with the spring assembly (1') embedded integrally therein. The foam urethane member (7), by reason of the fact 7 that the spring assembly (1') was held unmoved by the securing members (5), is provided at the upper side with a layer having a substantially even thickness. Also, since the securing members (5) were removed from the urethane member (7), there are defined plural hollow portions (8) at the corresponding points. With those hollow portions (8), the coil portions of spring assembly (1') encircling them respectively are not influenced so much from the urethane member, thus exerting much of their metallic spring characteristics. Moreover, the urethane material is saved by amount of the hollow portions (8).

Figure 13:
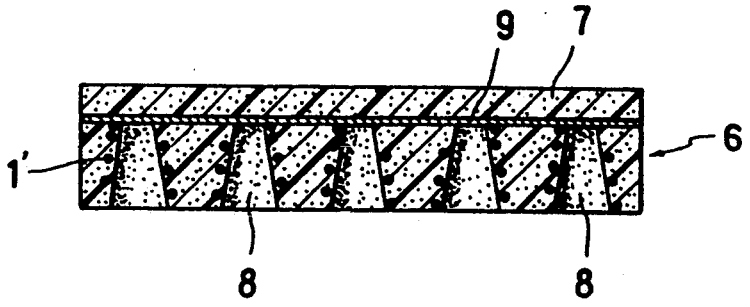
FIG. 13 is a sectional view of another embodiment of the resulting cushion body.

A cushion body (6) shown in FIG. 13 is basically similar to that as in FIG. 12, excepting that a juncture cloth (7) knitted with loose stitches is embedded therein such as to be disposed above the upper end of spring assembly (1'). This improves greatly an interconnection between the spring assembly and foam urethane member, and in particular, provides an even distribution of a load over the cushion body when an occupant sits on the cushion body, applying such load to each of the spring assemblies.

Figure 14:
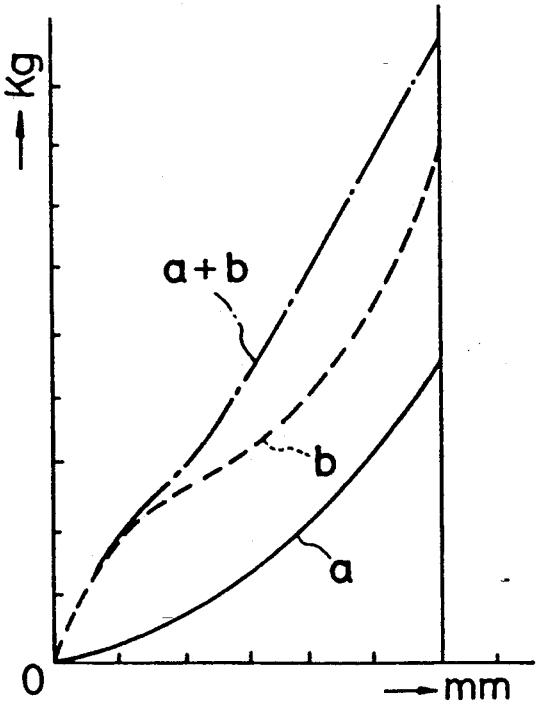
FIG. 14 is a graph showing a load-flexture relation of the resulting cushion member.

FIG. 14 shows graphic curves of load-flexture relation with regard to the characteristics of the above-formed integral foam cushion body. It is seen therefrom that a curve (a) indicating an elasticity characteristics of spring assembly (1') and another curve (b) indicating an elasticity characteristics of foam urethane member (7) are combined or added with each other, hence presenting a elasticity curve (a+b) as shown. It is noted that the spring assembly also includes the previously-stated entangled spring assembly (1).

According to the present invention, it is to be appreciated that plural separate sets of continuous coil-spring assemblies, forming one block body, can be subject to a foaming process together with a urethane base foam material, without equipping other restricting members (such as frame wires or pull wires) to the spring assemblies.

Conventionally, this sort of continuous spring assembly, when subjected to such annealing treatment in a furnace, as it is, results in being deformed in undesired way, and further, the entangled spring assembly, when treated by electric-resistance low temperature annealing method, ends up with generating sparks, thus rendering unpractical use of that electric annealing treatment.

However, employing the above-described jigs in the present invention allows application of the low-temperature annealing to the spring assembly, so that the spring assemlby is settled in shape and limit of elasticity. Namely, by reason of the continuous spring assembly being retained by the jigs for the annealing purpose, the following advantages are attained: The spring assembly is not deformed undesirably; the height of spring can be varied as desired to a low level than an initially set height; and the spring assembly can be provided partway with a different height, or provided with a slope at its upper side, according to a required seat structural designs.

Furthermore, according to the invention, the spring assembly may be subjected to the foaming process with urethane foam material, in a singular row or in plural rows, and still further, the aforementioned low-temperature annealing treatment is effective in burning out a thing attached to the surface of original wire material, such as an oil, thereby eliminating a degreasing step, which in turn enhances bonding between the urethane member and spring assembly made from such wire material.

The provision of securing members in the mold to secure the spring assembly (for securing the coil portions of same) realizes a stable securing of plural sets of spring assemlies which has no other support means, thereby assuring a stable, integral foaming with the urethane foam material.

According to the invention, even the spring assembly having not more than 2.0 $\phi$ wire diameter proves to be more adaptable for mounting onto the securing members, by virtue of such small wire diameter which provides adequate elasticity to meet such adaptability while needing support means at the same time to avoid unstable state thereof In this respect, the linear connection parts of spring assembly serve to make firm the bonding between the spring assemblies and urethane member.

Yet further, the hollow portions formed inwardly of the respective coil portions of spring assembly enhance the elasticity characteristics of spring assembly.

What is claimed is:

1. A cushion body comprising:
   a singular row of or plural rows of continuous coil-spring assemblies, which have been inserted into a jig means and subject to a low-temperature annealing treatment together with said jig means;
   a foam urethane member;
   wherein said jig means includes an inclined part;
   wherein a part of said continuous coil-spring assemblies has been formed in a sloped fashion by said jig means;
   wherein said foam urethane member has been formed by foaming integrally with the thus-formed continuous coil-spring assemblies; and
   wherein said part of said continuous coil-spring is formed by said jig means into a pair of sloped areas defined at an upper side of said continuous coil-spring assemblies, and wherein said pair of slope areas are disposed in both sides of said cushion body.

2. The cushion body as defined in claim 1, wherein said jig means comprises a jig having a shape in section, thus having an upper side and lower side therein an wherein one or both of said sides is inclined.

3. The cushion body as defined in claim 2 wherein said lower side of said jig has a raised central portion conforming to the configuration of an automotive power train tunnel, so whereby a portion of a lower side of coil spring assembly is biased upwardly.

4. The cushion body as defined in claim 1, wherein said foam urethane member has been formed by foaming integrally with said continuous coil-spring assemblies subsequent to said low-temperature treatment.

5. A cushion body comprising:
   a singular row of or plural rows of continuous coil-spring assemblies, which have been inserted into a jig means and subject to a low-temperature annealing treatment together with said jig means;
   a foam urethane member;
   wherein said jig means includes an inclined part;
   wherein a part of said continuous coil-spring assemblies has been formed in a sloped fashion by said jig means; and
   wherein said foam urethane member has been formed by foaming integrally with the thus-formed continuous coil-spring assemblies;
   wherein a juncture cloth with loose stitches is disposed above said continuous coil-spring assemblies.

6. The cushion body as defined in claim 5, wherein said continuous coil-spring assemblies are entangled coil-spring assemblies.

7. The cushion body as defined in claim 5, wherein said continuous coil-spring assemblies are non-entangled, sequential coil-spring assemblies.

* * * * *